US009301622B2

(12) United States Patent
Kozel

(10) Patent No.: US 9,301,622 B2
(45) Date of Patent: Apr. 5, 2016

(54) SHELL FOR MATTRESS FOR ADJUSTABLE BED

(75) Inventor: Anne Kozel, Atlanta, GA (US)

(73) Assignee: DREAMWELL, LTD., Las Vegas, NV (US)

( * ) Notice: Subject to any disclaimer, the term of this patent is extended or adjusted under 35 U.S.C. 154(b) by 530 days.

(21) Appl. No.: 12/960,269

(22) Filed: Dec. 3, 2010

(65) Prior Publication Data

US 2011/0138534 A1 Jun. 16, 2011

Related U.S. Application Data

(60) Provisional application No. 61/267,256, filed on Dec. 7, 2009.

(51) Int. Cl.

| | |
|---|---|
| ***A47B 71/00*** | (2006.01) |
| ***A47C 21/00*** | (2006.01) |
| ***A47C 19/00*** | (2006.01) |
| ***A47C 19/22*** | (2006.01) |
| ***A47C 21/02*** | (2006.01) |

(52) U.S. Cl.

CPC ..... *A47C 21/003* (2013.01); *A47C 19/00* (2013.01); *A47C 19/22* (2013.01); *A47C 21/026* (2013.01)

(58) Field of Classification Search

USPC ..... 5/78, 610, 925, 659, 904, 905

See application file for complete search history.

(56) References Cited

U.S. PATENT DOCUMENTS

| | | | | |
|---|---|---|---|---|
| 3,872,526 | A * | 3/1975 | Betts | 5/674 |
| 4,114,215 | A * | 9/1978 | Santo | 5/666 |
| 5,015,037 | A * | 5/1991 | Giblin et al. | 297/452.1 |
| 5,267,362 | A * | 12/1993 | Johenning et al. | 5/400 |
| 5,291,624 | A * | 3/1994 | Strobel | 5/400 |
| 5,347,682 | A * | 9/1994 | Edgerton, Jr. | 16/34 |
| 5,557,813 | A * | 9/1996 | Steed et al. | 5/739 |
| 5,906,878 | A * | 5/1999 | Horning et al. | 428/131 |

(Continued)

FOREIGN PATENT DOCUMENTS

| | | |
|---|---|---|
| EP | 1541109 A1 | 8/2003 |
| EP | 2181624 A2 | 5/2010 |

(Continued)

OTHER PUBLICATIONS

International Preliminary Report on Patentability, issued in International Patent Application No. PCT/US2010/058947, dated Jun. 21, 2012; 5 pages.

(Continued)

*Primary Examiner* — Timothy D Collins
*Assistant Examiner* — Richard G Davis
(74) *Attorney, Agent, or Firm* — Cantor Colburn LLP

(57) ABSTRACT

The systems and methods described herein include a shell that fits around the mattress of an adjustable bed. The shell may help cover unsightly pivot joints and motors that are part of the adjustable bed. The shell may help hold the mattress in place during the operation of the adjustable bed, or when a user exits or enters the bed. The shell may further help keep the shape of the mattress and prevent the mattress from sagging with time and use. Additionally, the systems and methods described herein include for providing additional features in the shell. Such features may help the user be more comfortable in the adjustable bed, and improve the user's quality of life. These features may be especially useful for patients confined an adjustable bed for prolonged periods of time, such as in a hospital or elderly home care.

19 Claims, 9 Drawing Sheets

(56) References Cited

U.S. PATENT DOCUMENTS

| | | | | |
|---|---|---|---|---|
| 6,684,425 | B2 | 2/2004 | Davis | |
| 6,785,922 | B2 * | 9/2004 | Bretschger et al. | 5/694 |
| 6,857,152 | B1 * | 2/2005 | Chow | 5/681 |
| 7,127,075 | B2 * | 10/2006 | Park | 381/151 |
| 7,353,550 | B2 | 4/2008 | Antinori | |
| 7,376,994 | B2 * | 5/2008 | Wu | 5/694 |
| 7,444,705 | B2 * | 11/2008 | Chang | 5/713 |
| 7,454,805 | B2 * | 11/2008 | Osborne et al. | 5/618 |
| 8,266,747 | B1 * | 9/2012 | Sobran et al. | 5/739 |
| 2007/0157388 | A1 * | 7/2007 | Mossbeck et al. | 5/618 |
| 2007/0163045 | A1 * | 7/2007 | Becker et al. | 5/616 |
| 2007/0169267 | A1 * | 7/2007 | Paz et al. | 5/610 |
| 2008/0000028 | A1 * | 1/2008 | Lemire et al. | 5/618 |
| 2009/0064415 | A1 * | 3/2009 | Payne et al. | 5/620 |
| 2009/0070929 | A1 * | 3/2009 | Holman | 5/93.1 |
| 2009/0177327 | A1 * | 7/2009 | Turner et al. | 700/275 |

FOREIGN PATENT DOCUMENTS

| | | | |
|---|---|---|---|
| FR | 2849583 | A | 3/2001 |
| NL | 1032699 | A | 10/2006 |
| WO | 9834518 | A | 8/1998 |
| WO | 2004028306 | A1 | 4/2004 |
| WO | 2009055432 | A2 | 4/2009 |

OTHER PUBLICATIONS

Stay Furniture Grippers. Retrieved from http://www.etsy.com/listing/29553862/stay-furniture-grippers-keep-furniture on Nov. 22, 2010 (excerpt).

* cited by examiner

SHELL FOR MATTRESS FOR ADJUSTABLE BED

CROSS-REFERENCE TO RELATED APPLICATIONS

This application claims priority to and the benefit of U.S. Provisional Patent Application Ser. No. 61/267,256, filed Dec. 7, 2009 and entitled "Shell for Mattress for Adjustable Bed", the entire contents of which are incorporated herein by reference.

BACKGROUND

Adjustable beds offer the advantage of allowing a user to orient themselves between a horizontal position and an inclined position. They work well and are very common in environments such as hospital rooms. Typically the adjustable bed comprises a motorized frame that has a pivot joint so that one portion of the frame can move relative to the other portion of the frame. A motor rotates the movable portion of the frame about the pivot point, causing the frame to move into an inclined position. The adjustable bed may offer different levels of incline as per the user's wishes, e.g., for watching TV, or for eating. A conventional mattress is typically placed on the frame. However, visible pivot joints and motors can be unsightly. Also, each time the user exits a bed when the bed is inclined, the mattress tries to return to its original shape and may shift around on the bed, lift covers off the bed, and throw any reading materials or other objects onto the floor.

SUMMARY

The systems and methods described herein include a shell that fits around the mattress of an adjustable bed. The shell may help cover unsightly pivot joints and motors that are part of the adjustable bed. The shell may help hold the mattress in place during the operation of the adjustable bed, or when a user exits or enters the bed. The shell may further help keep the shape of the mattress and prevent the mattress from sagging with time and use. Additionally, the systems and methods described herein include for providing additional features in the shell. Such features may help the user be more comfortable in the adjustable bed, and improve the user's quality of life. These features may be especially useful for patients confined an adjustable bed for prolonged periods of time, such as in a hospital or elderly home care.

More particularly, the systems and methods include, among other things, shells that fit around the mattress of an adjustable bed, and provide additional features such as peripheral connectors, physical attachments, adjustable legs, remote control operation, and grip pads to prevent the mattress from slipping. In one aspect, a shell for an adjustable bed mattress includes a hollow rectangular enclosure formed from a plurality of rectangular panels. Each rectangular panel has a top edge, a bottom edge, and two side edges. Each rectangular panel also has a front face and a back face extending between the two side edges on opposite sides of the panel. The hollow rectangular enclosure of the shell is formed by joining the plurality of rectangular panels along their respective side edges. The shell further includes a power module, a control module, and a communications module, disposed on one or more of the rectangular panels. The power module provides electrical power. The control module allows a user to control the adjustable bed mattress. The communications module allows for communication with an electrical device.

In another aspect, an adjustable bed assembly includes a mattress enclosed in a shell, as described above.

In some embodiments, the power module includes a power outlet, a power strip, a power status indicator, a surge protector, or a backup battery. In some embodiments, the control module includes an infrared receiver, a BLUETOOTH receiver, a WIFI receiver, a cellular receiver, or a panel comprising one or more physical switches. In some embodiments, the communications module includes a USB port, an Ethernet port, a telephone jack, a coaxial jack, an MP3 device connector, a FIREWIRE port, a serial port, a parallel port, an infrared receiver, a BLUETOOTH receiver, a WIFI receiver, or a cellular receiver. In some embodiments, a wireless remote controller may allow a user to operate and control the adjustable bed mattress. In some embodiments, the shell further includes a physical storage module for providing physical storage and/or a media module for providing access to media. The physical storage module may include a drawer, a remote caddy, or a refrigerator. The media module may include a computer system, an alarm clock, a television receiver, a radio receiver, a telephone receiver, a webcam, and an audio speaker.

In some embodiments, one or more of the rectangular panels are adjustable, and include an adjustable portion for changing a dimension of the rectangular panel to help conform the rectangular panel to varying sizes of an adjustable bed mattress. In some embodiments, the shell includes a headboard attached to the hollow rectangular enclosure, and one or more of a power module, a control module, and a communications module disposed on the headboard. The headboard may be attached to the rectangular panel of the shell closer to where the user typically places his head, or closer to where the user typically places his feet. In some embodiments, the shell includes a mattress retainer. A webcam may be disposed on the mattress retainer. The mattress retainer may be attached to the rectangular panel closer to where the user typically places his head, or closer to where the user typically places his feet. In some embodiments, one or more of the rectangular panels has a height approximately equal to the height of the adjustable bed mattress. The shell includes four legs, attached at each corner. The legs may be adjustable and may include regular, retractable, and/or foldable wheels.

In some embodiments, a base is disposed within the hollow rectangular enclosure and attached to the plurality of rectangular panels for supporting the adjustable bed mattress. One or more slide-resistant grip pads may be disposed on the base and/or the adjustable bed mattress to help hold the mattress in place during the operation of the adjustable bed. The grip pad may be made of rubber, and include a plate of poly-carbonate at least partially enclosed in the rubber. The rubber may include includes holes to act like suction cups, improving grip of the grip pad.

BRIEF DESCRIPTION OF THE FIGURES

The foregoing and other objects and advantages of the systems and methods described herein will be appreciated more fully from the following further description thereof, with reference to the accompanying drawings wherein.

DETAILED DESCRIPTION

To provide an overall understanding of the systems and methods described herein, certain illustrative embodiments will now be described, including systems and methods for a shell that fits around the mattress of an adjustable bed. However, it will be understood by one of ordinary skill in the art that the systems and methods described herein may be adapted and modified for other suitable applications and that such other additions and modifications will not depart from the scope thereof.

Figure 1:
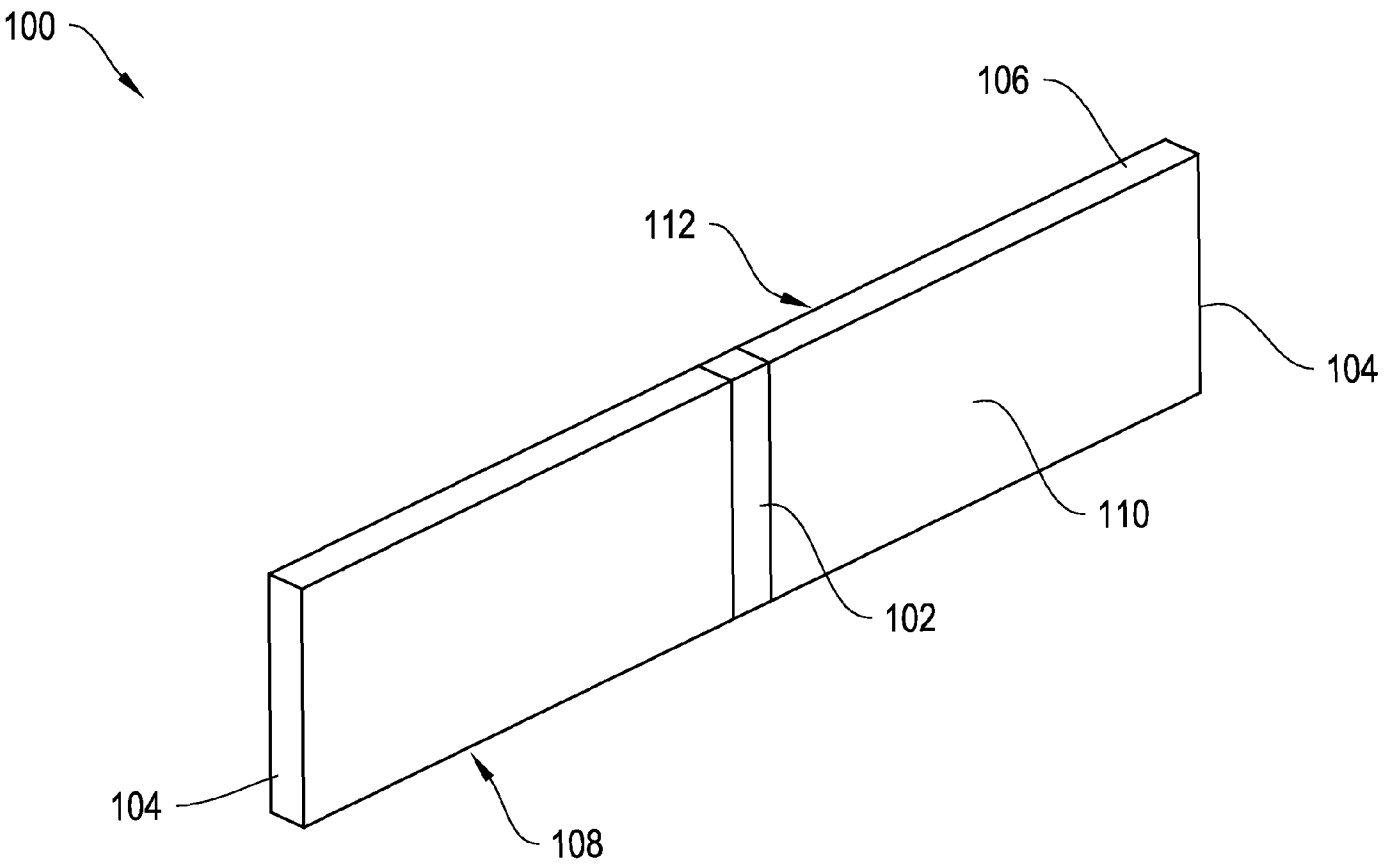
FIG. 1 depicts a rectangular panel for forming a shell for an adjustable bed mattress, according to an illustrative embodiment of the invention.

The systems and methods include, among other things, shells that fit around the mattress of an adjustable bed, and provide additional features such as peripheral connectors, physical attachments, adjustable legs, remote control operation, and grip pads to prevent the mattress from slipping. The shell may include a hollow rectangular enclosure formed from a plurality of rectangular panels. FIG. 1 shows an illustrative embodiment of a rectangular panel 100. Each rectangular panel has a top edge 106, a bottom edge 108, and two side edges 104. Each rectangular panel also has a front face 110 and a back face 112 extending between the two side edges 104. As will be described in more detail with references to FIGS. 2A-4, the plurality of rectangular panels 100 may be joined along their respective side edges to form a hollow rectangular enclosure. Each rectangular panel may have different dimensions as needed in order to properly form the enclosure around the adjustable bed mattress. In some embodiments, one or more rectangular panels 100 measure the same as the height of the adjustable bed mattress. The rectangular panels may be adjustable, by means of adjustable portion 102. Adjustable portion 102 may be an interface between two portions of the rectangular panel 100. For example, portion 102 may have a lower thickness than the two portions of rectangular panel 100. Adjustable portion 102 may slide in and out of a portion of rectangular panel 100 in order to adapt the dimensions of the rectangular panel to varying sizes of an adjustable bed mattress. Adjustable portion 102 may include screws, fasteners, or interlocking mechanisms to keep the two portions of the rectangular panel 100 securely attached while allowing the rectangular panel to expand.

Figure 2A:
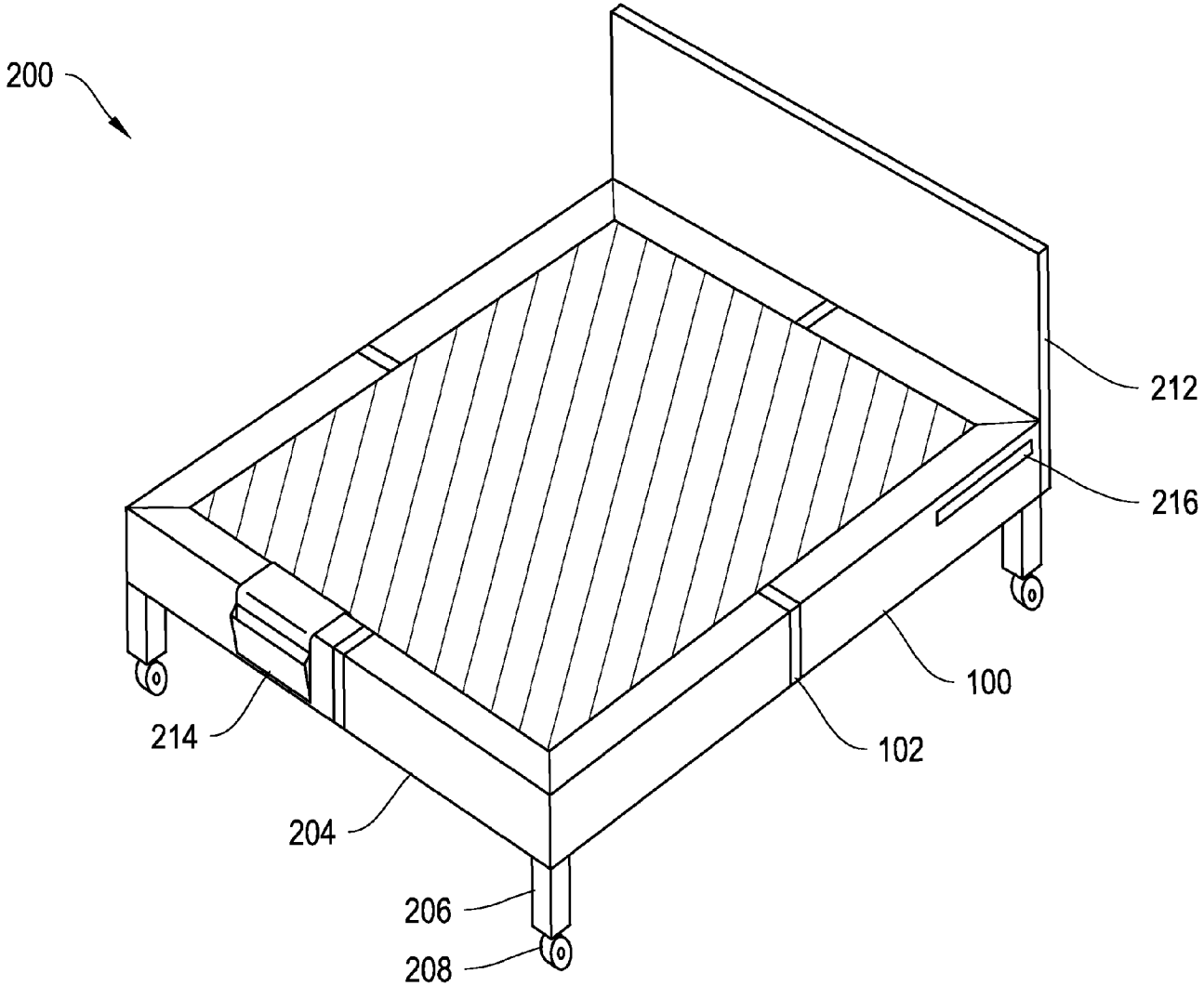
FIGS. 2A and 2B depict views of a shell for an adjustable bed mattress, according to an illustrative embodiment of the invention.
Figure 2B:
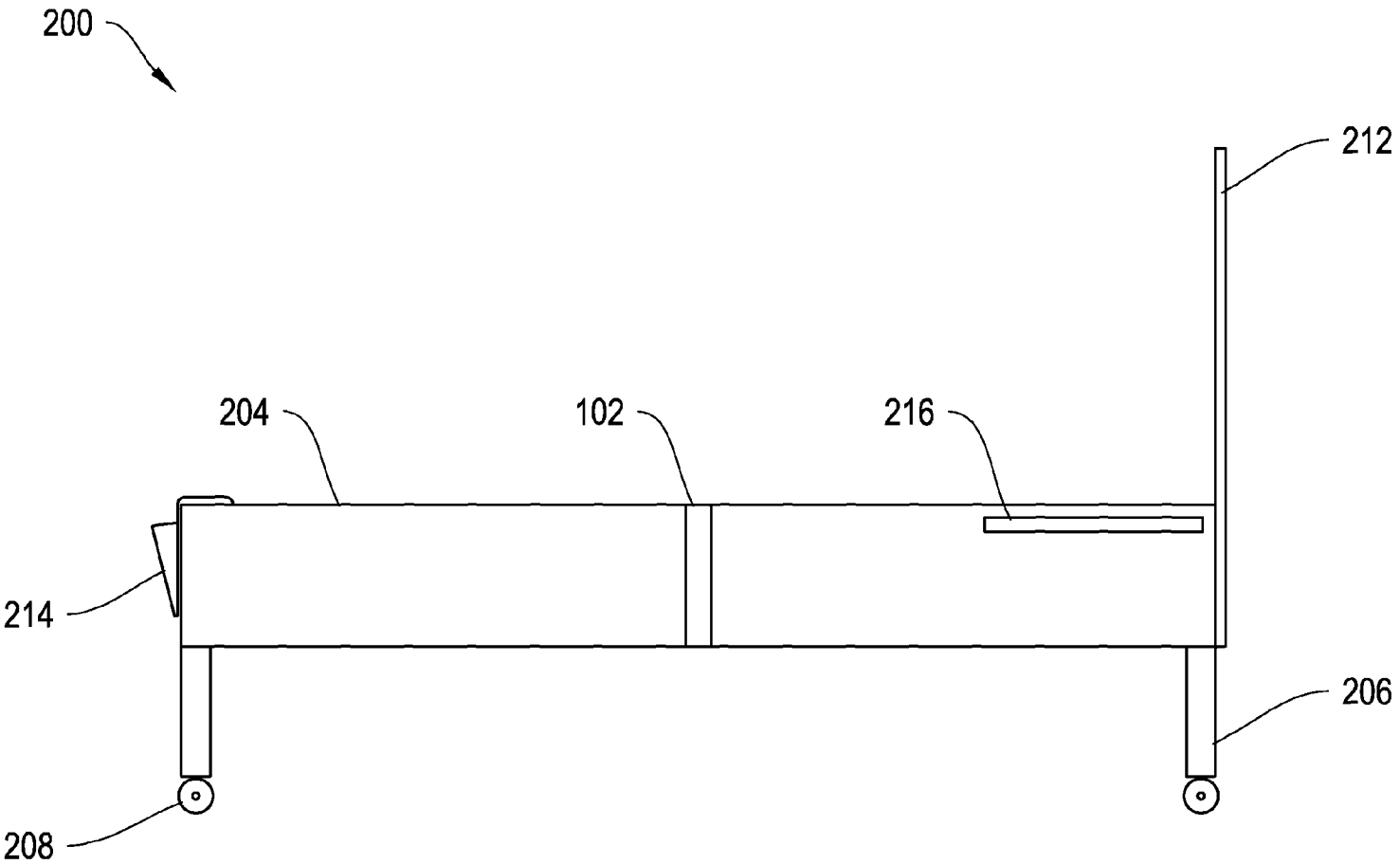

FIGS. 2A and 2B show perspective and side views of an illustrative embodiment of a shell for an adjustable mattress. Shell 200 may help hold the mattress in place during the operation of the adjustable bed, or when a user exits or enters the bed. Shell 200 may further help keep the shape of the mattress and prevent the mattress from sagging with time and use. Shell 200 includes a hollow rectangular enclosure 204 formed from four rectangular panels 100. A side edge of each rectangular panel is attached to another using an interlocking mechanism, an adhesive, or a bonding agent. In some embodiments, the hollow rectangular enclosure 204 is of unitary construction formed using, for example, a mold. In some embodiments, one or more rectangular panels 100 is adjustable, and includes an adjustable portion 102 that helps conform the rectangular panel to varying sizes of an adjustable bed mattress. Shell 200 may include four legs 206 attached to the rectangular panels 100, one at each corner. They may include attached and/or retracting wheels for mobility, as well as brakes for safety. In the embodiment shown, legs 206 include wheels 208. In some embodiments, each leg may not have an attached wheel. In some embodiments, the wheels and/or the legs may be adjustable and/or foldable. The wheels may be retracted via a lever on the shell, or via remote control. The wheels may fold to the side of the leg, or retract into the body of the leg. The brakes may be activated manually, via a remote controller, or activated automatically as a safety precaution.

Shell 200 includes headboard 212 attached to the rectangular panel of the shell closer to where the user typically places his head. The shell may include a mattress retainer attached to the rectangular panel of the shell closer to where the user typically places his feet. In some embodiments, shell 200 includes one or more physical storage modules. For example, shell 200 includes a caddy 214 that is attached to the foot end of the shell. Caddy 214 may be used to store wireless remote controllers, magazines, books, and other such suitable material. In another example, the physical storage module may include trays or tables. They trays may be disposed and hidden within shell 200 inside opening 216. Opening 216 may house a foldable tray table like the type shown in, e.g., tray table 414 of FIG. 4. One or more openings like opening 216 may be disposed on any of the rectangular panels 100. One or more modules as described above in reference to FIGS. 2A and 2B may be disposed on any of the rectangular panels, the headboard, and the mattress retainer.

Figure 3A:
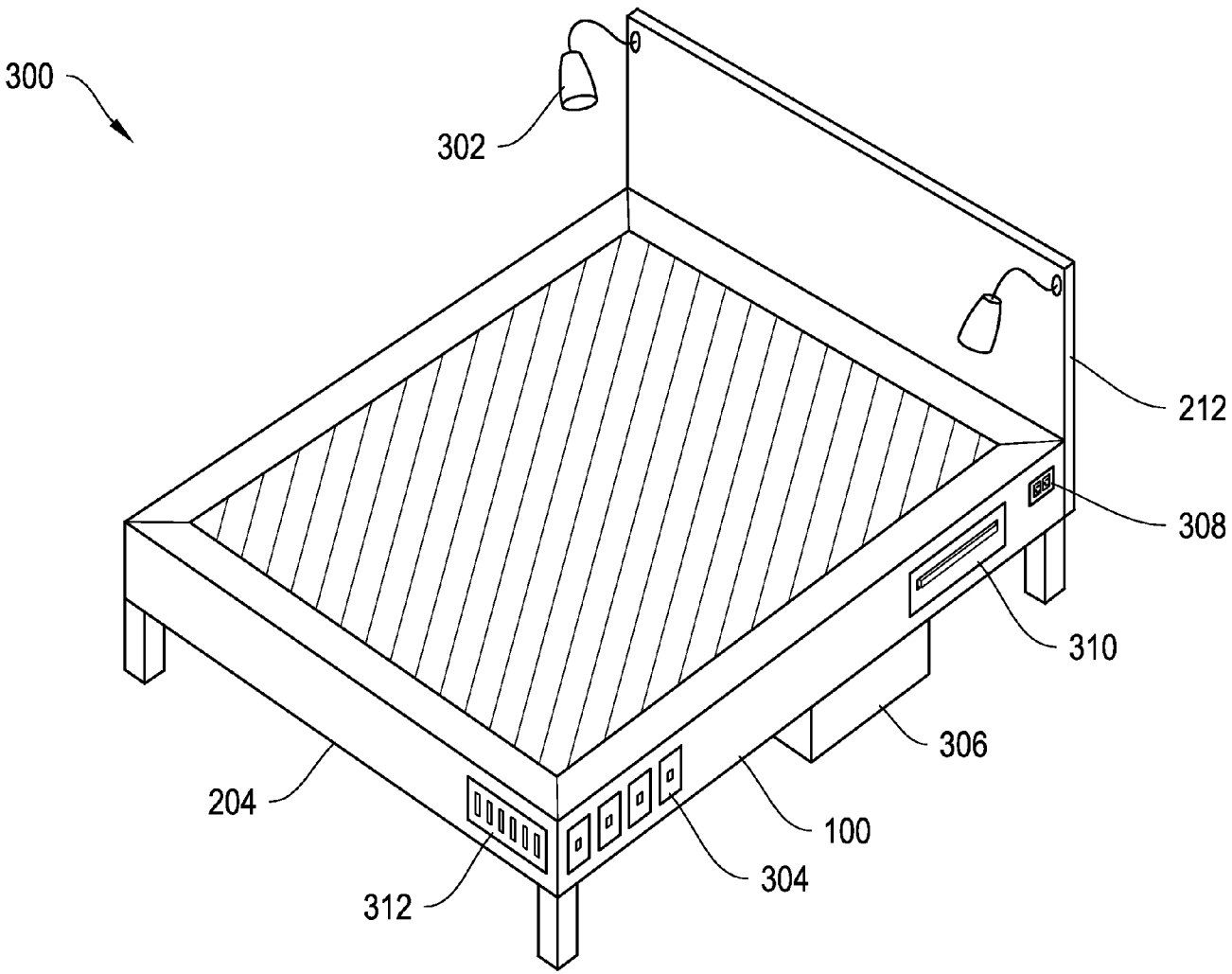
FIGS. 3A and 3B depict views of a shell for an adjustable bed mattress having several components, according to another illustrative embodiment of the invention.
Figure 3B:
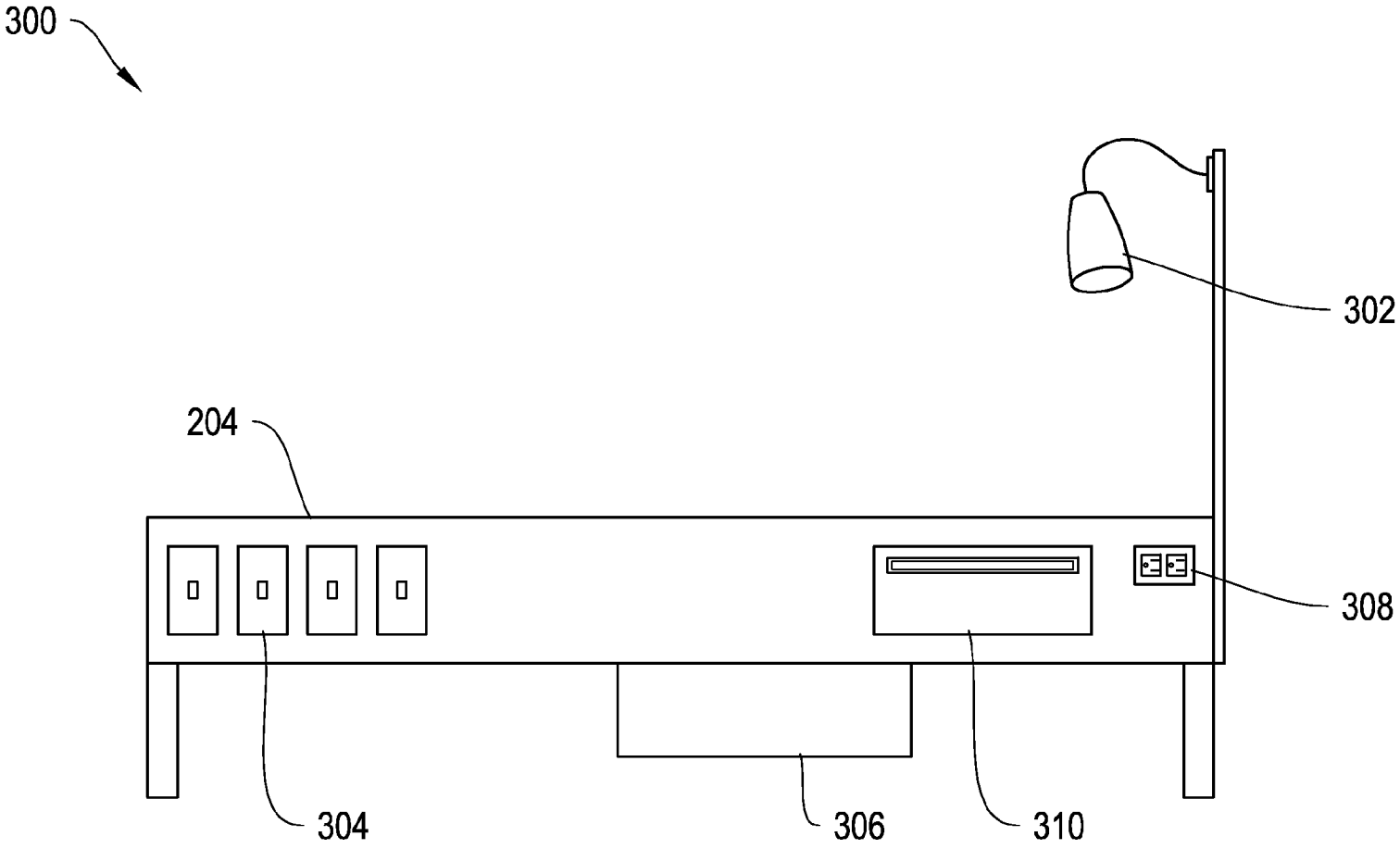

In some embodiments, the shell may include several components for, e.g., components for making the user of the adjustable bed mattress more comfortable. FIGS. 3A and 3B show perspective and side views of such a shell for an adjustable mattress having several such components. In the embodiment shown, shell 300 includes a hollow rectangular enclosure 204 formed from four rectangular panels 100, and legs 206 attached to each of the rectangular panels 100. Shell 300 further includes headboard 212 attached to the end of the shell where the user typically places his head. In some embodiments, lighting module 302 may be attached to headboard 212 or rectangular panel 100. In the embodiment shown, lighting module 302 includes a bed-side lamp. In some embodiments, lighting module 302 may include lighting fixtures such as table lamps, desk lamps, portable lamps (e.g., clipped to headboard 212), night lamps, reading lamps, and other suitable lighting fixtures. Lighting module 302 may use light sources such as halogen light bulbs, light emitting diode (LED) light bulbs, compact fluorescent lamp (CFL) light bulbs, fluorescent light bulbs, conventional incandescent bulbs, and other suitable light sources.

In some embodiments, one or more of rectangular panels 100 may include communications module 304. Communications module 304 may include a USB port, an Ethernet port, a telephone jack, a coaxial jack, an MP3 device connector, a FIREWIRE port, a serial port, a parallel port, an infrared receiver, a BLUETOOTH receiver, a WIFI receiver, or a cellular receiver. The ports may allow the user to connect any compatible electronic device, and further allow for interoperability with other shell features. For example, connecting an MP3 device (e.g., an IPOD, sold by Apple Computer, Inc., Cupertino, Calif.) to the MP3 device connector (e.g., an IPOD dock), may automatically connect the output to speakers also mounted on the shell. A coaxial jack connects to a television mounted on the shell. A telephone jack may connect to a telephone or intercom system mounted on the shell. An Ethernet port may connect a user device, such as a laptop, to the Internet. Another Ethernet port may connect to a device mounted on the shell that offers control of the shell's features to a remote user.

In some embodiments, one or more rectangular panels 100 may include power module 308. Power module 308 may include a power outlet, a power strip, a power status indicator, a surge protector, or a backup battery. Power outlets on the shell obviate the need for potentially hazardous external power cords which a user may inadvertently trip over. A surge protector may protect the adjustable bed mechanisms and any mounted electrical and electronic devices from power spikes and other variations in the power supply. The backup battery may provide power in case of emergencies, or when the adjustable bed is moved from one room to another. For example, the backup battery may provide power for the user's respiratory ventilation machine in case of a power outage.

In some embodiments, one or more rectangular panels 100 may include control module 312. Control module 312 may include an infrared receiver, a BLUETOOTH receiver, a WIFI receiver, a cellular receiver, or a panel comprising one or more physical switches. Control module 312 may allow operation of the adjustable bed and other modules remotely or locally based on user input. For example, control module 312 may receive input from a wireless remote controller to allow a user to operate and control the adjustable bed mattress. In some embodiments, the shell may be connected to the Internet via a mounted Ethernet port, and may offer control of the adjustable bed as well as some or all attached peripheral devices to a remote user. This feature may allow a remote user to assist a user of the bed in adjusting the position of the bed, monitor the user's condition via webcam, or operate any of the electrical and electronic devices attached to the shell.

In some embodiments, one or more rectangular panels 100 may include physical storage module 306. Physical storage module 306 may include physical attachments for storage or support, such as drawers, magazine racks, remote caddies, cup holders, refrigerators, and tray tables. The drawers may serve as storage, or hold any of the electrical or electronic devices built into the shell. For example, a refrigerator may be mounted on the side of or under the shell, and holds items such as food, drink, or medicine, for the user. One or more magazine racks may be attached to any of the rectangular panels of the shell, or on the headboard or mattress retainer. One or more remote caddies may be attached to any of the rectangular panels of the shell, or on the headboard or mattress retainer. In some embodiments, a remote caddy may have slots for holding magazines, and in another embodiment, a magazine rack may have slots for holding remotes. One or more cup holders may be attached to any of the rectangular panels of the shell, or on the headboard or mattress retainer. In some embodiments, the cup holder may include a heating element to keep beverages warm. One or more tray tables may be attached to any of the rectangular panels of the shell, or on the headboard or mattress retainer. The tray tables may be customized for, but not limited to, certain functions such as reading, watching television, eating, or using a laptop computer. In some embodiments, a tray table may include one or more cup holders. Such a tray table would be useful to avoid spillage of beverages on the bed. One or more modules as described above in reference to FIGS. 3A and 3B may be disposed on any of the rectangular panels, the headboard, and the mattress retainer.

Figure 4:
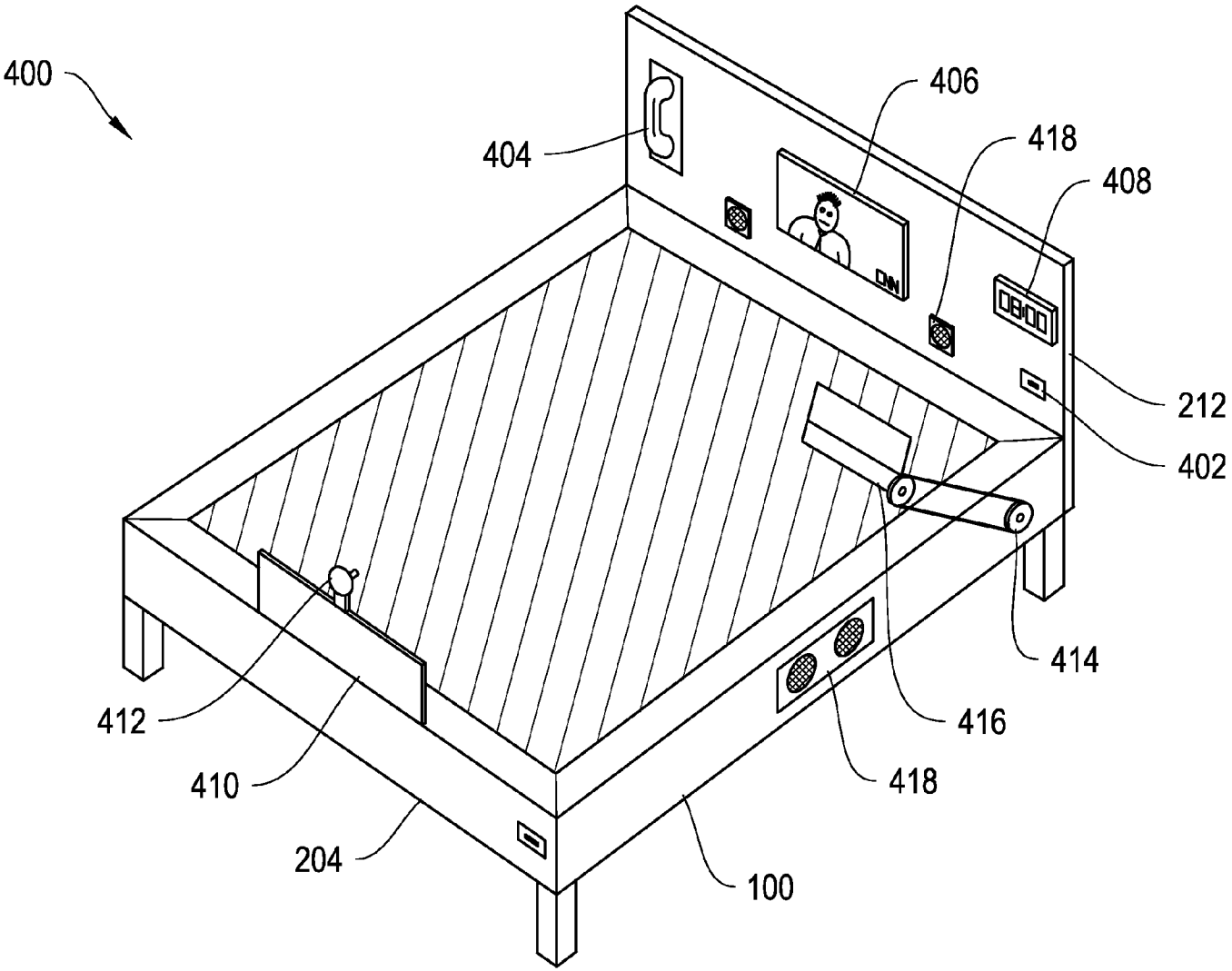
FIG. 4 depicts a perspective view of a shell for an adjustable bed mattress having several additional components and a mattress retainer, according to yet another illustrative embodiment of the invention.

In some embodiments, the shell may include additional components and a mattress retainer. FIG. 4 shows a perspective view of such an embodiment of a shell 400 for an adjustable mattress. Shell 400 includes a hollow rectangular enclosure 204 formed from four rectangular panels 100, and legs 206 attached to each of the rectangular panels 100. Shell 400 further includes headboard 212 attached to the rectangular panel of the shell closer to where the user typically places his head, and mattress retainer 410 attached to the rectangular panel of the shell closer to where the user typically places his feet. Mattress retainer 410 may be disposed on the rectangular panel, attached to at least one of a front face, a back face, a top edge, and a bottom edge of the rectangular panel, and extending upwardly from a point of attachment to the rectangular panel. In some embodiments, the shell may include a combination of a headboard and a mattress retainer where their positions may be switched. In some embodiments, the headboard and/or the mattress retainer may be the same width and the same height as the rectangular panel to which it is attached. In the embodiment shown, shell 400 may include one or more media modules for mounting electronic media devices, such as televisions, speakers, alarm clocks, laptops, webcams, telephones, or any other suitable electronic device. Shell 400 may include control modules 402 disposed on any of the rectangular panels 100, headboard 212, or mattress retainer 410. Control module 402 may include, e.g., an infrared receiver, for controlling the adjustable bed mattress and/or mounted electronic media devices. The devices may be mounted on rectangular panels 100, headboard 212, or mattress retainer 410. For example, a television receiver 406 may be disposed on headboard 212. Television receiver 406 may not be viewable by a user lying in the bed, and therefore, portable screen 416 may be disposed for the user on tray table 414. Tray table 414 may be attached to rectangular panel 100 of the shell, headboard 212, or mattress retainer 410. Speakers 418 may be mounted on a rectangular panel 100, headboard 212, or mattress retainer 410. The speaker system may include one or more speakers. The speakers may receive input from a variety of devices mounted on the shell, such as the MP3 device connector and the television, and may even serve as the speakers for a speakerphone.

Alarm clock 408 may be mounted on any of the rectangular panels 100, headboard 212, or mattress retainer 410. The alarm clock may connect to the speakers for added functionality. The alarm clock may also serve as the clock for other devices mounted on the shell. For example, other electronic devices may synchronize to the time shown on alarm clock 408. A laptop computer may be built in to the shell, or mounted on a tray table (e.g., tray table 414) attached to the shell. A webcam 412, along with a microphone, may be mounted on mattress retainer 410 or headboard 212, or on any of the rectangular panels 100. The webcam may allow the user of the bed to interact with friends, family, doctors, or other people that are unable to be physically present at the same location as the user. The webcam may allow a remote user to monitor the user of the bed, or the environment around the adjustable bed. The user of the bed may receive video from the remote user via the laptop or television mounted on the shell. A telephone system 404, which may or may not include an intercom system, may be mounted on any of the rectangular panels 100 of the shell, headboard 212, or mattress retainer 410. The telephone system may connect to the speaker system for speakerphone functionality, or include speakerphone functionality itself. The telephone system may include one or more cordless receivers for portability. One or more modules as described above in reference to FIGS. 3A and 3B may be disposed on any of the rectangular panels, the headboard, and the mattress retainer.

Figure 5:
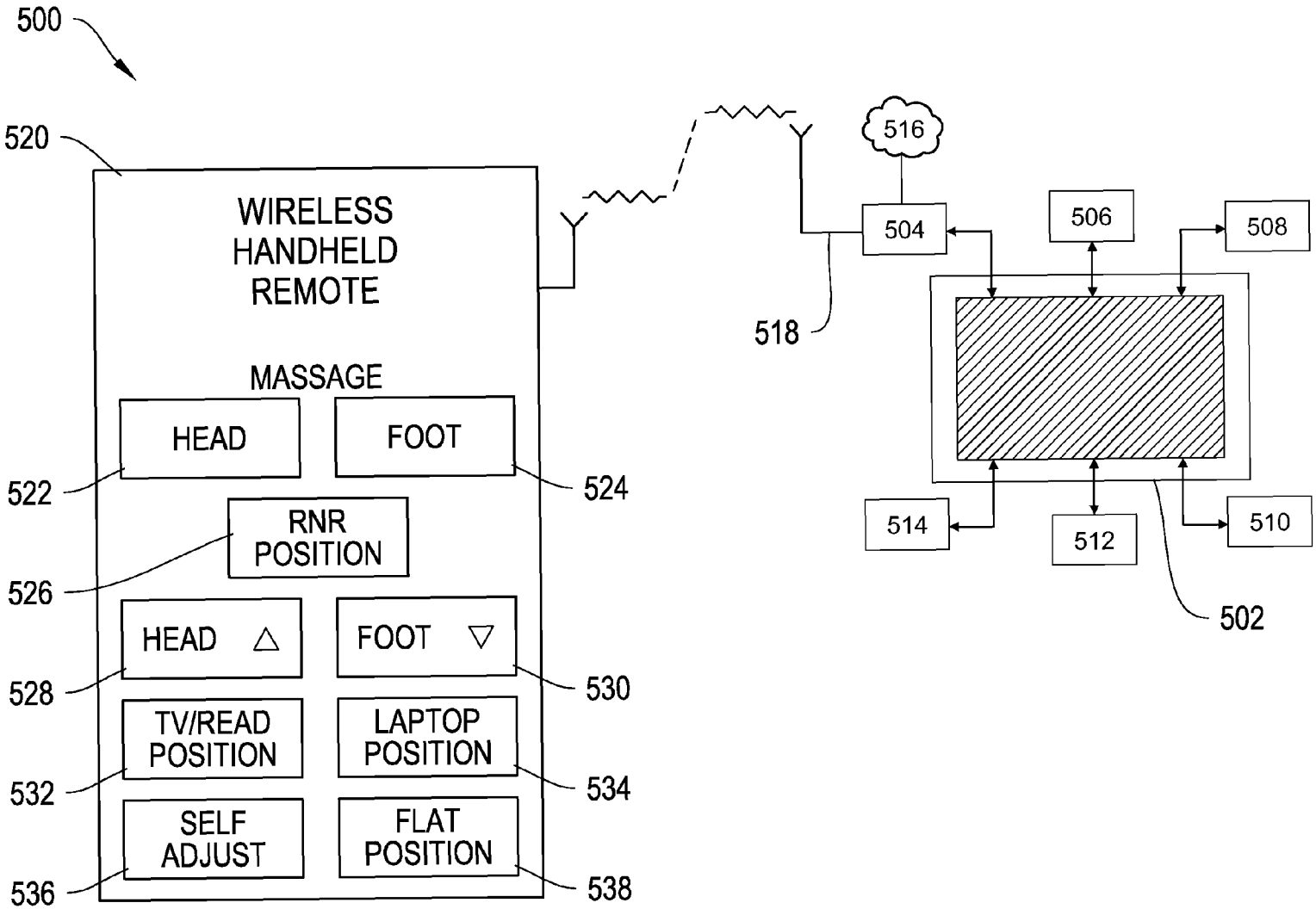
FIG. 5 depicts a block diagram of an interface between a shell for an adjustable bed mattress and a user, according to an illustrative embodiment of the invention.

The additional features for the shell described above help may help the user be more comfortable in the adjustable bed, and improve the user's quality of life. FIG. 5 depicts a block diagram 500 of an interface between a shell 502 for an adjustable bed mattress and a user. In the embodiment shown, shell 502 may have several modules 504-514 disposed on any one of the rectangular panels, the headboard, and/or the mattress retainer. For example, module 504 may be a communications module connected to a network 516 via an Ethernet port. Communications module 504 may include a panel of switches for controlling the features disposed on shell 502. Communications module 504 may further include an infrared receiver 518 for receiving user input from a wireless remote control 520.

Remote control 520 may include buttons for adjusting the position of the bed, and for some or all peripheral devices connected to the shell. The buttons may offer adjusting the bed to a position for watching television, another position for reading, another position for using a laptop computer, and yet another for sleeping or lying down. The remote may have a fastener, such as an adhesive on the back, to hold it in place when not in use. In the embodiment shown, the remote includes buttons 522 and 524 for Head and Foot massage, respectively. These buttons may control vibrating massagers installed on the shell. For example, pressing the button once may activate the massager at low speed. Pressing the button again may increase the speed to medium, pressing the button once more may increase the speed to high, and finally, one more press of the button may turn the massager off. The vibrating massagers may also automatically shut off after a certain period of time. The remote may include buttons for fine tuning the adjustment of the bed, with buttons for raising the Head or Foot side of the bed. The Head side may be defined as the side of the bed where the user typically places his head. The Foot side may be defined as the side of the bed where the user typically places his feet. In some embodiments, the user may initially press the Head button 528 to select the Head side of the bed, and then adjust the position up or down using the Head button 528 and Foot button 530. Similarly, the user may initially press the Foot button 530 to select the Foot side of the bed, and then adjust the position up or down using the Head button 528 and Foot button 530.

The remote may offer different bed positions, such as RNR Position, TV/Read Position, Laptop Position, and Flat Position. The RNR Position button 526 may work in combination with the massager to provide the user with a relaxing experience. The TV/Read Position button 532 may adjust the bed to a position comfortable for watching television or reading. The Laptop Position button 534 may adjust the bed to a position comfortable for operating a laptop computer. The Flat Position button 538 may adjust the bed to a position comfortable for sleeping or lying down. The Self Adjust button 536 may bring the bed to a position previously stored by the user. In some embodiments, to store settings for this feature, the user may set the bed position as desired and then press down on the Self Adjust button 536 for a few seconds. Pressing the Self Adjust button 536 may briefly bring the bed position to the settings stored by the user. In one embodiment, pressing the Self Adjust button 536 senses the pressure points as the user lies on the bed, and adjusts the bed to a more comfortable position. The mattress used in such an embodiment may include embedded pressure sensors to provide pressure point information for the Self Adjust feature.

In some embodiments, the peripheral devices, attachments, and the shell may be interoperable with each other. For example, when the bed position is adjusted to flat, i.e., for lying down or sleeping, the shell may automatically turn on the alarm clock depending on whether it is day time or night, or whether an alarm was previously set. As another example, when an MP3 device is connected to the MP3 device connector, the shell may automatically output audio to the speakers, and output video, if any, to the mounted television. As yet another example, the shell may automatically turn on a reading lamp when a tray table is pulled out. For example, when a digital camera is connected to the USB port, the shell may automatically download the pictures for display on the mounted television. For example, the shell may automatically turn on the night light when the user adjusts the bed to the flat position, and the clock shows that it is night time.

In some embodiments, a base is attached to the hollow rectangular enclosure for supporting the adjustable bed mattress. In typical adjustable beds, each time the user exits the bed when the bed is inclined, the mattress tries to return to its original shape. This may cause the mattress to pull away from the frame so that the center of the mattress is lifted off the frame. The result may be unsightly and annoying as the lifting may pull the covers off the bed and throw any reading materials or other objects onto the floor. In certain embodiments, the shell or adjustable bed mattress may include slide-resistant grip pads on the base and/or the adjustable bed mattress to hold the mattress in place and to prevent it from slipping.

Figure 6:
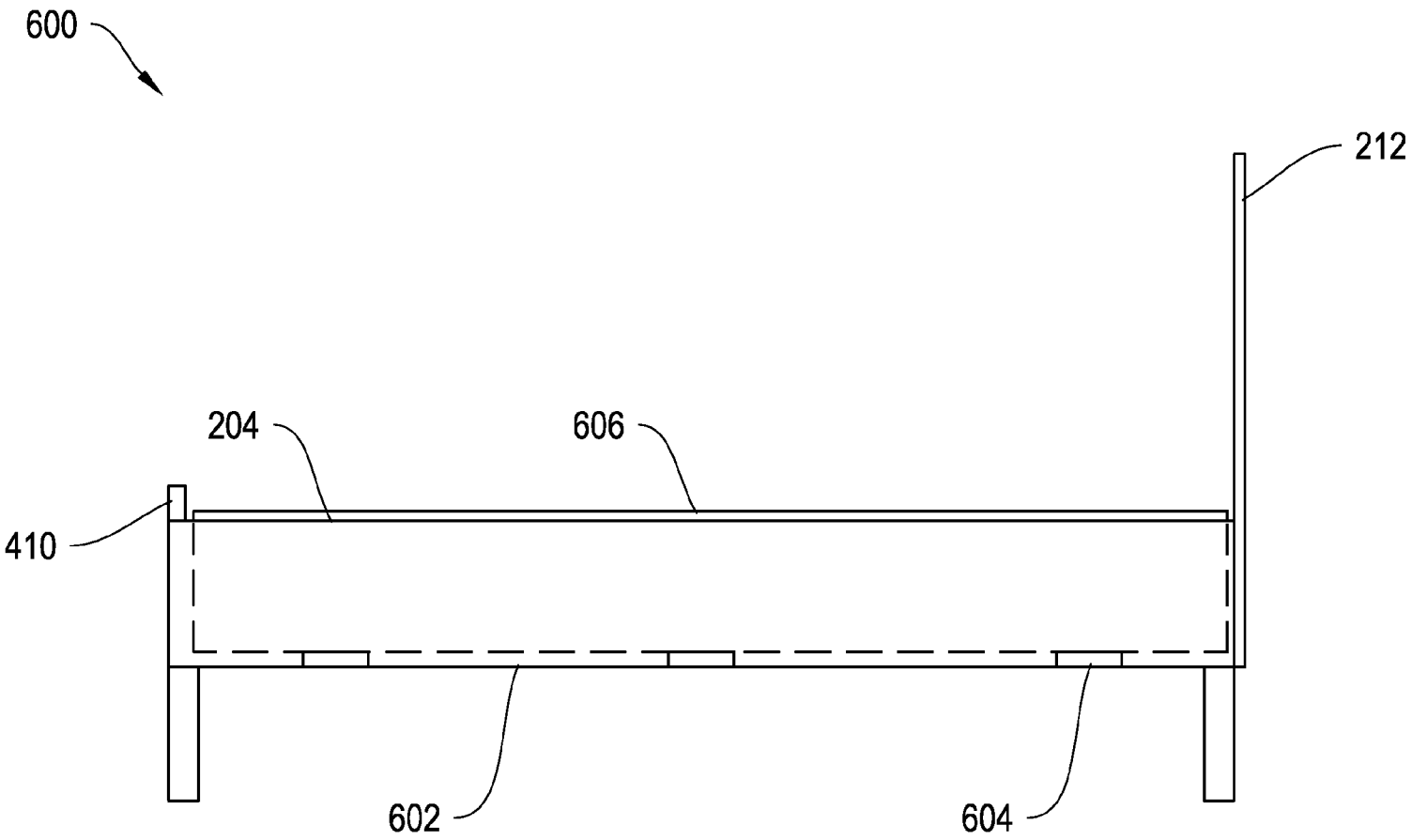
FIG. 6 depicts a side view of a shell for an adjustable bed mattress having a base and grip pads, according to yet another illustrative embodiment of the invention.

FIG. 6 shows a side view of an illustrative embodiment showing such grip pads disposed on the based of an adjustable bed mattress. Shell 600 includes a hollow rectangular enclosure 204 formed from four rectangular panels 100. Base 602 is disposed within hollow rectangular enclosure 204 and attached to the four rectangular panels 100 for supporting adjustable bed mattress 606. The shell may further include headboard 212 and mattress retainer 410. Grip pads 604 may be disposed on the base in the head region, the torso region, and/or the leg region. In some embodiments, grip pads 604 may be disposed on the bottom side of the adjustable bed mattress, e.g., a no-flip mattress. The grip pads may hold thick or thin mattresses in place. They may hold the mattress steady, as well keep the mattress and adjustable base from slipping apart.

Figure 7B:
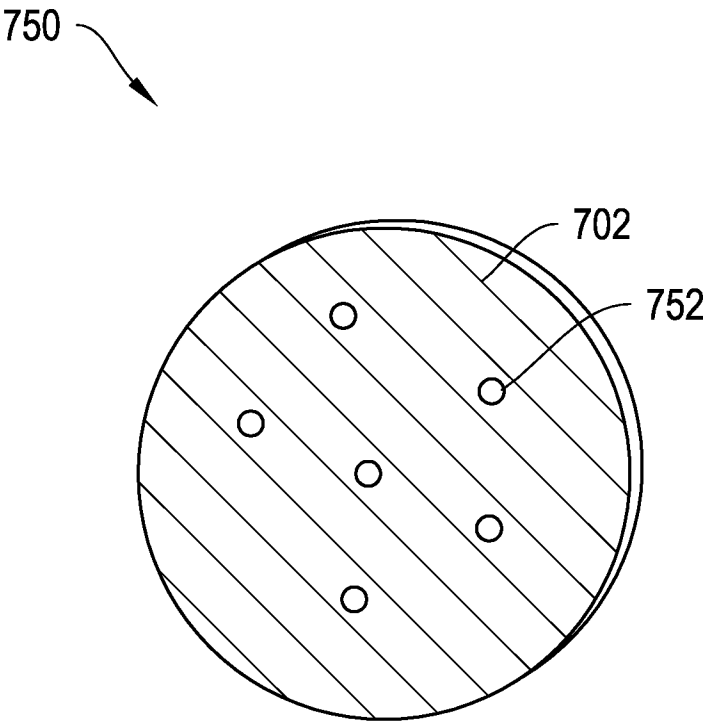
FIG. 7B depicts a grip pad, according to another illustrative embodiment of the invention.
Figure 7A:
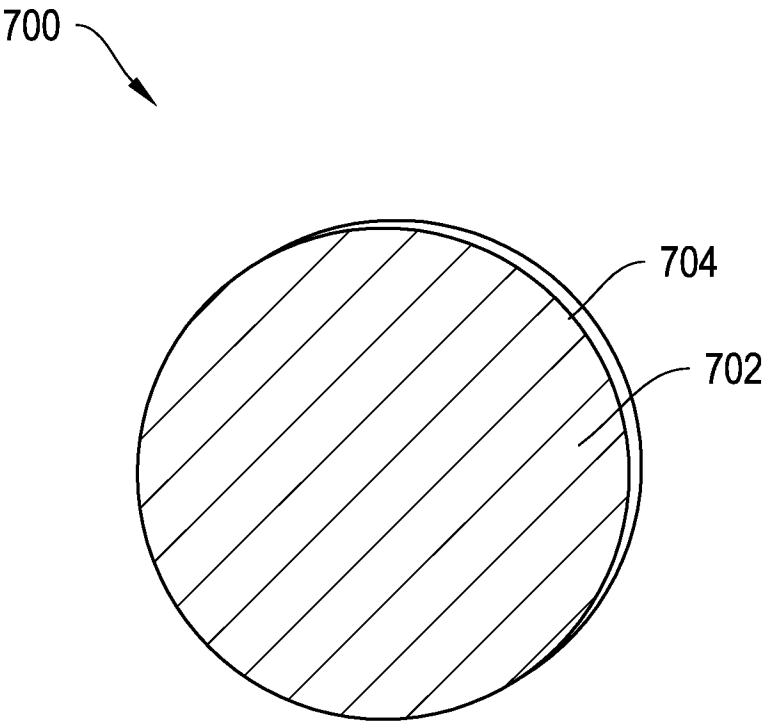
FIG. 7A depicts a grip pad, according to an illustrative embodiment of the invention.

FIGS. 7A and 7B show illustrative embodiments of grip pad 604. In some embodiments, grip pad 604 may be made of rubber 702. A plate of poly-carbonate may reside in the center of rubber 702 of grip pad 604, and may provide rigidity to the soft gripping, non-marking rubber 702. FIG. 7B shows grip pad 750 with holes 752 on both sides of rubber 702 that act like suction cups. The holes in rubber 702 may allow grip pad 750 to grip tightly to any dry surface. FIG. 7A shows grip pad 700 with no holes on either side of rubber 702. Grip pad 700 may still grip tightly to any dry surface. Both grip pads 700 and 750 are shown as being substantially round in shape. In some embodiments, the grip pad may be round, square, or of any other suitable shape. In some embodiments, a grip pad may not need to be glued or nailed, and may leave no sticky residue. In some embodiments, one or more grip pads 700 and/or 750 placed in the leg region may conform to the shape of the user's leg. In some embodiments, a grip pad 700 or 750 may be thick to help quiet noise when the mattress is adjusted.

Variations, modifications, and other implementations of what is described may be employed without departing from the spirit and scope of the invention. More specifically, any of the method, system, and device features described above or incorporated by reference may be combined with any other suitable method, system of device features disclosed herein or incorporated by reference, and is within the scope of the contemplated inventions. The systems and methods may be embodied in other specific forms without departing from the spirit or essential characteristics thereof. The foregoing embodiments are therefore to be considered in all respects illustrative, rather than limiting of the invention.

What is claimed is:

1. A shell for an adjustable bed assembly comprising:

a hollow rectangular enclosure configured to surround a motorized frame including a pivot joint so that one portion of the motorized frame can move relative to another portion of the motorized frame and optionally support an adjustable bed mattress, the hollow rectangular enclosure consisting of four rectangular linear panels, wherein each rectangular linear panel is free of curvature and has a rectangular cross section, a top edge, a bottom edge, side edges, and a front planar face facing outward from a side of the adjustable bed assembly and a back planar face extending between the side edges and facing inward from a side of the adjustable bed assembly, and wherein the four rectangular linear panels are joined along their respective side edges to define the hollow rectangular enclosure, and wherein two of the four rectangular linear panels define a width dimension of the hollow rectangular enclosure and correspond to a head end and a foot end of the adjustable bed assembly, and the other two of the four rectangular linear panels define a length dimension of the hollow rectangular enclosure and correspond to a side of the adjustable bed assembly, a power module disposed in a front panel face of at least one of the two rectangular linear panels defining the length dimension or the panel corresponding to the foot end of the hollow rectangular enclosure for providing electrical power, a control module disposed in a front panel face of at least one of the two rectangular linear panels defining the length dimension or the panel corresponding to the foot end of the hollow rectangular enclosure for allowing a user to control the adjustable bed mattress, a communications module disposed in a front panel face of at least one of the two rectangular linear panels defining the length dimension or the panel corresponding to the foot end of the hollow rectangular enclosure for communication with an electrical device;

wherein the front facing panel is perpendicular to a sleeping surface of the adjustable bed mattress, and wherein the adjustable bed mattress is disposed within the hollow rectangular enclosure.

2. The shell for the adjustable bed assembly of claim 1, further comprising a base disposed within the hollow rectangular enclosure and attached to the plurality of rectangular panels for supporting the adjustable bed mattress, and a slide-resistant grip pad disposed on at least one of the base and the adjustable bed mattress for preventing the adjustable bed mattress from sliding.

3. The shell for the adjustable bed assembly of claim 1, further comprising a mattress retainer disposed on a rectangular panel of the plurality of rectangular panels, attached to at least one of a front face, a back face, a top edge, and a bottom edge of the rectangular panel, and extending upwardly from a point of attachment to the rectangular panel.

4. The shell for the adjustable bed assembly of claim 1, wherein the power module comprises one of a power outlet, a power strip, a power status indicator, a surge protector, and a backup battery.

5. The shell for the adjustable bed assembly of claim 1, wherein the control module comprises one of an infrared receiver, a BLUETOOTH receiver, a WIFI receiver, a cellular receiver, and a panel comprising one or more physical switches.

6. The shell for the adjustable bed assembly of claim 1, wherein the communications module comprises one of a USB port, an Ethernet port, a telephone jack, a coaxial jack, an MP3 device connector, a FIREWIRE port, a serial port, a parallel port, an infrared receiver, a BLUETOOTH receiver, a WIFI receiver, and a cellular receiver.

7. The shell for the adjustable bed assembly of claim 1, further comprising one of a physical storage module for providing physical storage and a media module for providing access to media.

8. The shell for the adjustable bed assembly of claim 7, wherein the physical storage module comprises one of a drawer, a remote caddy, and a refrigerator.

9. The shell for the adjustable bed assembly of claim 7, wherein the media module comprises one of a computer system, an alarm clock, a television receiver, a radio receiver, a telephone receiver, a webcam and an audio speaker.

10. The shell for the adjustable bed assembly of claim 1, wherein at least one of the plurality of rectangular panels comprises an adjustable portion for changing a dimension of the rectangular panel to aid in conforming to varying sizes of the adjustable bed mattress.

11. The shell for the adjustable bed assembly of claim 1, further comprising a headboard attached to the hollow rectangular enclosure, and at least one of a power module, a control module, and communications module disposed on the headboard.

12. The shell for the adjustable bed assembly of claim 1, further comprising one or more adjustable legs.

13. The shell for the adjustable bed assembly of claim 12, wherein a leg of the one or more adjustable legs includes a foldable wheel.

14. The shell for the adjustable bed assembly of claim 1, further comprising a base disposed within the hollow rectangular enclosure and attached to the plurality of rectangular panels for supporting the adjustable bed mattress, and a slide-resistant grip pad disposed on the base for preventing the adjustable bed mattress from sliding.

15. The shell for the adjustable bed assembly of claim 14, wherein the grip pad includes a plate of poly-carbonate at least partially enclosed in rubber.

16. The shell for the adjustable bed assembly of claim 14, wherein the rubber of the grip pad includes one or more holes to improve grip via suction.

17. The shell for the adjustable bed assembly of claim 1, further comprising a mattress retainer disposed on a rectangular panel of the plurality of rectangular panels, attached to at least one of a front face, a back face, a top edge, and a bottom edge of the rectangular panel, and extending upwardly from a point of attachment to the rectangular panel.

18. The shell for the adjustable bed assembly of claim 17, further comprising a webcam disposed on the mattress retainer.

19. The shell for the adjustable bed assembly of claim 1, further comprising a wireless remote controller for controlling the adjustable bed mattress.

* * * * *